US005966564A

United States Patent [19]

Kizaki et al.

[11] Patent Number: 5,966,564

[45] Date of Patent: Oct. 12, 1999

[54] IMAGE FORMING APPARATUS AND METHOD WITH CLEANING FEATURES

[75] Inventors: Osamu Kizaki, Asaka; Fumihito Ito, Yokohama, both of Japan

[73] Assignee: Ricoh Company, Ltd., Tokyo, Japan

[21] Appl. No.: 09/031,657

[22] Filed: Feb. 27, 1998

[30] Foreign Application Priority Data

Feb. 27, 1997 [JP] Japan ..... 9-043917

[51] Int. Cl.[6] ..... G03G 15/16

[52] U.S. Cl. ..... 399/101; 399/297; 399/308

[58] Field of Search ..... 399/101, 297, 399/308, 309, 312, 313, 314, 316, 317

[56] References Cited

U.S. PATENT DOCUMENTS

| | | | |
|---|---|---|---|
| 5,079,597 | 1/1992 | Mauer et al. | 399/302 |
| 5,559,590 | 9/1996 | Arai et al. | 399/314 |
| 5,614,998 | 3/1997 | Sanpe | 399/314 |
| 5,732,310 | 3/1998 | Hiroshima et al. | 399/101 |
| 5,809,373 | 9/1998 | Yoda et al. | 399/101 |
| 5,812,919 | 9/1998 | Takano et al. | 399/312 |

FOREIGN PATENT DOCUMENTS

| | | |
|---|---|---|
| 54-063838 | 5/1979 | Japan . |
| 1-105980 | 4/1989 | Japan . |
| 5-297739 | 11/1993 | Japan . |
| 5-333706 | 12/1993 | Japan . |
| 8-022201 | 1/1996 | Japan . |
| 9-044007 | 2/1997 | Japan . |
| 9-244430 | 9/1997 | Japan . |

*Primary Examiner*—Matthew S. Smith

*Attorney, Agent, or Firm*—Oblon, Spivak, McClelland, Maier & Neustadt, P.C.

[57] ABSTRACT

An image forming apparatus and method are provided that effectively remove inversely charged toner and normally charged toner attached to a transfer medium by employing two cleaning modes of operation. In a first cleaning operational mode, in which a transfer belt is brought into contact with a non-charged photosensitive body and a transfer bias is applied thereto from a bias roller, the inversely charged toner attached to the transfer belt is fully transferred onto the photosensitive body. Furthermore, in a second cleaning mode of operation, the transfer belt is brought into contact with the non-charged photosensitive body and the transfer bias is not applied hereto, as a consequence the normally charged toner attached to the transfer belt is fully transferred onto the photosensitive body.

11 Claims, 9 Drawing Sheets

IMAGE FORMING APPARATUS AND METHOD WITH CLEANING FEATURES

BACKGROUND OF THE INVENTION

1. Field of the Invention

The present invention relates to image forming apparatuses and methods like those employed in the form of copying machines, printers, facsimile devices, and the like. More particularly, the invention relates to a method and apparatus capable of eliminating dirt of a recording paper's rear surface and preventing an insufficient cleaning of the transfer medium.

2. Description of the Related Arts

In an image forming apparatus utilizing an electrophotographic process, the electrostatic latent image formed on the image carrier such as photosensitive drum, etc. is developed with toner or the like. The toner image thus formed thereon is transferred onto the recording medium (hereinafter, called "recording paper") such as transfer paper, overhead projection (OHP) film, etc. As to the transfer medium, there exist two types: a non-contact type transfer medium represented by a corona charger, and the like; and a contact type transfer medium represented by a transfer belt, a transfer roller, etc. In recent years, there is an increasing trend to employ the non-contact type transfer medium, primarily because of its superior electric current efficiency, image quality, and apparatus maintenance ease.

As presently observed, in a developing apparatus used to apply toner (or other image forming substance) to an electrophotographic latent image formed on an image carrier, a portion of the toner is charged with a polarity opposite to that of the normal charge imparted on the toner. The occurrence of such inversely charged toner tends to happen very often in the initial state of shipping the product from the factory or in the initial state of exchanging the developer. Another cause of a portion of the toner becoming inversely charged is due to an aging of the toner and a deterioration of carrier that mixes with the toner.

When the inversely charged toner attaches to a non-image portion (that is, a background portion) on the image carrier, this portion of toner attaches to the transfer medium physically (not electrostatically, but mechanically) by pressing against the image carrier when employing the contact type transfer medium.

The attachment phenomenon is especially pronounced when the transfer medium remains in contact with the image carrier when performing successive copying operations. Under these conditions, the inversely charged toner existing on the non-image portion of the image carrier corresponding to the area between the adjacent recording papers becomes attached to the transfer medium on some occasions. As a result, if the transfer process for a next recording paper is performed while leaving the inversely charged toner attached to the transfer medium, the inversely charged toner attaches to the rear surface of the recording paper and results in dirtying the rear surface of the recording paper.

The published specification of Japanese Laid-open Patent Publication No. 8-110712/1996 discloses one approach for preventing the rear surface of the recording paper from becoming dirty due to the inversely charged toner. The technology of the image forming apparatus described in the above specification takes a countermeasure of preventing the inversely charged toner from being transferred onto a transfer belt by applying a transfer bias to the non-image portion (on the image carrier) corresponding to the area between the adjacent recording papers when performing a successive copying operation.

However, although the image forming apparatus as described in the above specification can prevent the transferring of the inversely charged toner by applying the transfer bias to the non-image portion (the area between the adjacent papers), an undesirable phenomenon of normal toner (the normally charged toner) becoming electrostatically absorbed onto the transfer medium occurs inevitably. Since the normally charged toner attached to the transfer medium is electrostatically absorbed, a sufficient cleaning operation cannot be performed by way of a transfer belt cleaning member, etc. and thereby a phenomenon of "toner filming" tends to occur very often.

As previously mentioned, the attaching of the inversely charged toner to the transfer medium and the attaching of the normally charged toner thereto are very closely related to each other. The countermeasure of coping with both of the problems to be solved requires mutually contradictory treatments. Furthermore, it is impossible to effectively prevent both of the inversely charged toner and the normally charged toner from being attached to the transfer medium in the conventional image forming apparatus. Those are the problems to be solved in the prior art, as recognized by the present inventors.

SUMMARY OF THE INVENTION

The present invention was made in consideration of the above-mentioned problems, and it is an object of the present invention to solve these problems.

It is another object of the present invention to provide an image forming apparatus and method capable of improving the above-mentioned problems.

It is still another object of the present invention to provide an image forming apparatus and method capable of effectively preventing toner, normally charged and inversely charged, from being attached to the transfer medium.

It is still another object of the present invention to provide an image forming apparatus and method not requiring any cleaning operation for the transfer medium by eliminating the phenomenon of attaching the toner to the transfer medium.

It is still another object of the present invention to provide a method of improving the image quality by use of the aforementioned image forming apparatus.

These and other objects and achieved with an image forming apparatus and method that effectively remove inversely charged toner and normally charged toner attached to a transfer medium by employing two cleaning modes of operation. In a first cleaning operational mode, a transfer belt is brought into contact with a non-charged photosensitive body and a transfer bias is applied thereto from a bias roller. As a consequence, the inversely charged toner attached to the transfer belt is fully transferred onto the photosensitive body. Furthermore, in a second cleaning mode of operation, the transfer belt is brought into contact with the non-charged photosensitive body and the transfer bias is not applied hereto. As a consequence, the normally charged toner attached to the transfer belt is fully transferred onto the photosensitive body. Thus, the transfer medium is cleaned and is free of attached toner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
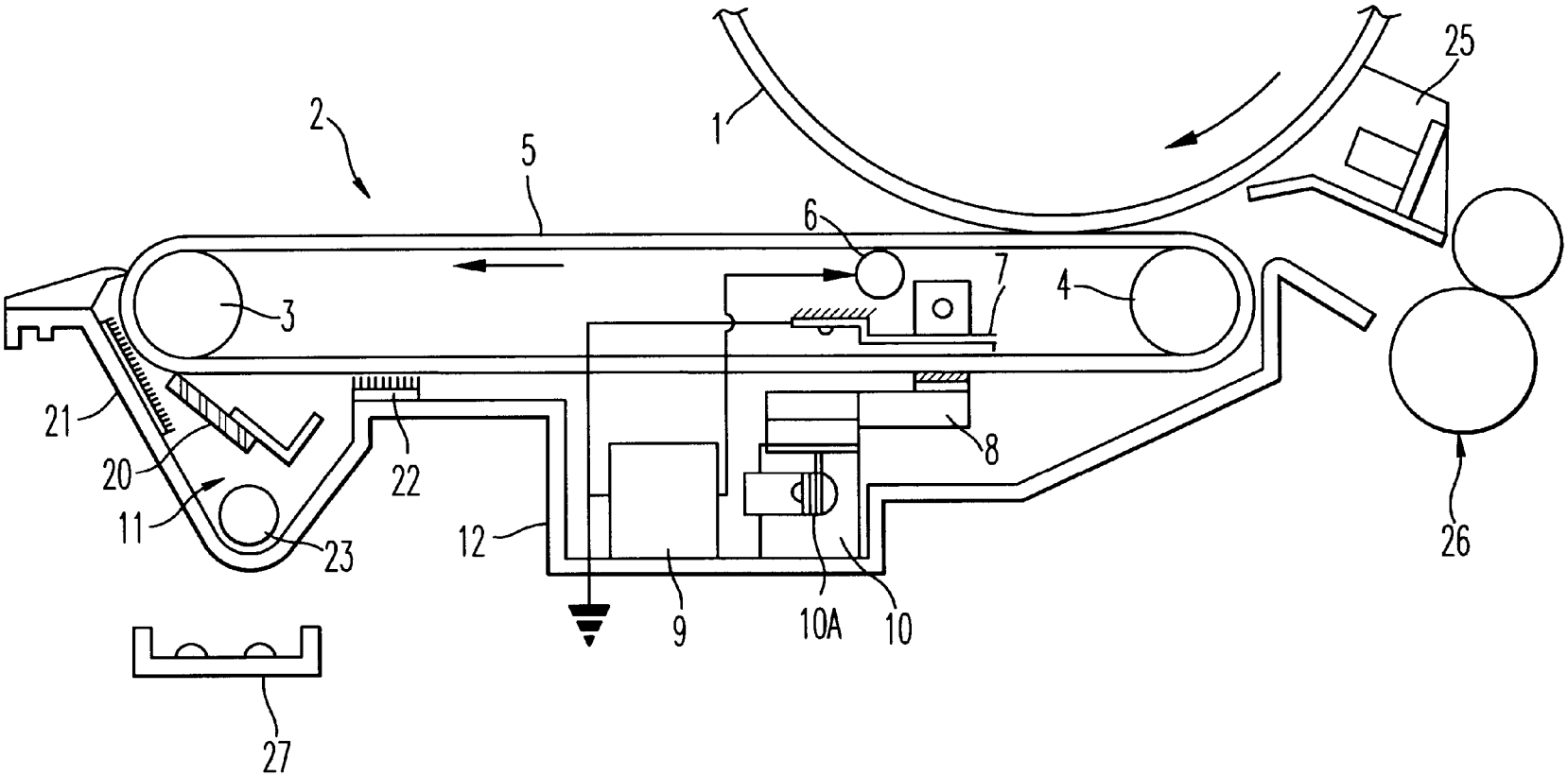
FIG. 1 is a cross-sectional view of an outlined structure near a transfer medium in an image forming apparatus of an embodiment according to the present invention.

Referring now to the drawings, wherein like reference numerals designate identical or corresponding parts throughout the several views, and more particularly to FIG. 1 thereof, there is illustrated a cross-sectional view showing an outlined structure near a transfer medium in an image forming apparatus of the embodiment according to the present invention. The image forming apparatus of the embodiment is applicable to the copying machine adopting a positive-positive system. However, since the construction of the image forming apparatus utilizing the electrophotographic method is same as the one of the well-known conventional apparatus, only the portion near the transfer medium relating to the present invention is described in detail hereinafter.

In FIG. 1, an optical photoconductor (OPC) charged in negative polarity (−) is employed as a photosensitive body 1 functioning as an image carrier. On this occasion, a bias of negative polarity is applied on the photosensitive body 1 as the developing bias of the developing unit. The polarity of the normally charged toner is plus (+) and the polarity of the inversely charged toner is minus (−). Of course, it is allowable to change both of those polarities, respectively, to the opposite ones. The photosensitive body 1 is not limited to the drum, but a belt-like photosensitive body can be used also.

A pre-transfer charge removing lamp (PTL) 25 is included for lowering the surface electric potential of the photosensitive body 1 and a registration roller 26 feeds the recording paper, with a suitable timing, into the space between the photosensitive body 1 and the transfer medium (to be described later) and are respectively arranged at the right side of the photosensitive body 1.

A transfer medium 2 is disposed below the photosensitive body I and is mainly composed of a driving roller 3, a driven roller 4, a transfer belt 5, a transfer bias roller 6, a contact plate 7, a contact lever 8, a power sources for use in the transferring, a transfer belt attaching/detaching medium 10, and a transfer belt cleaning medium 1 1, and all of those elements are accommodated in the interior of a case.

Figure 2:
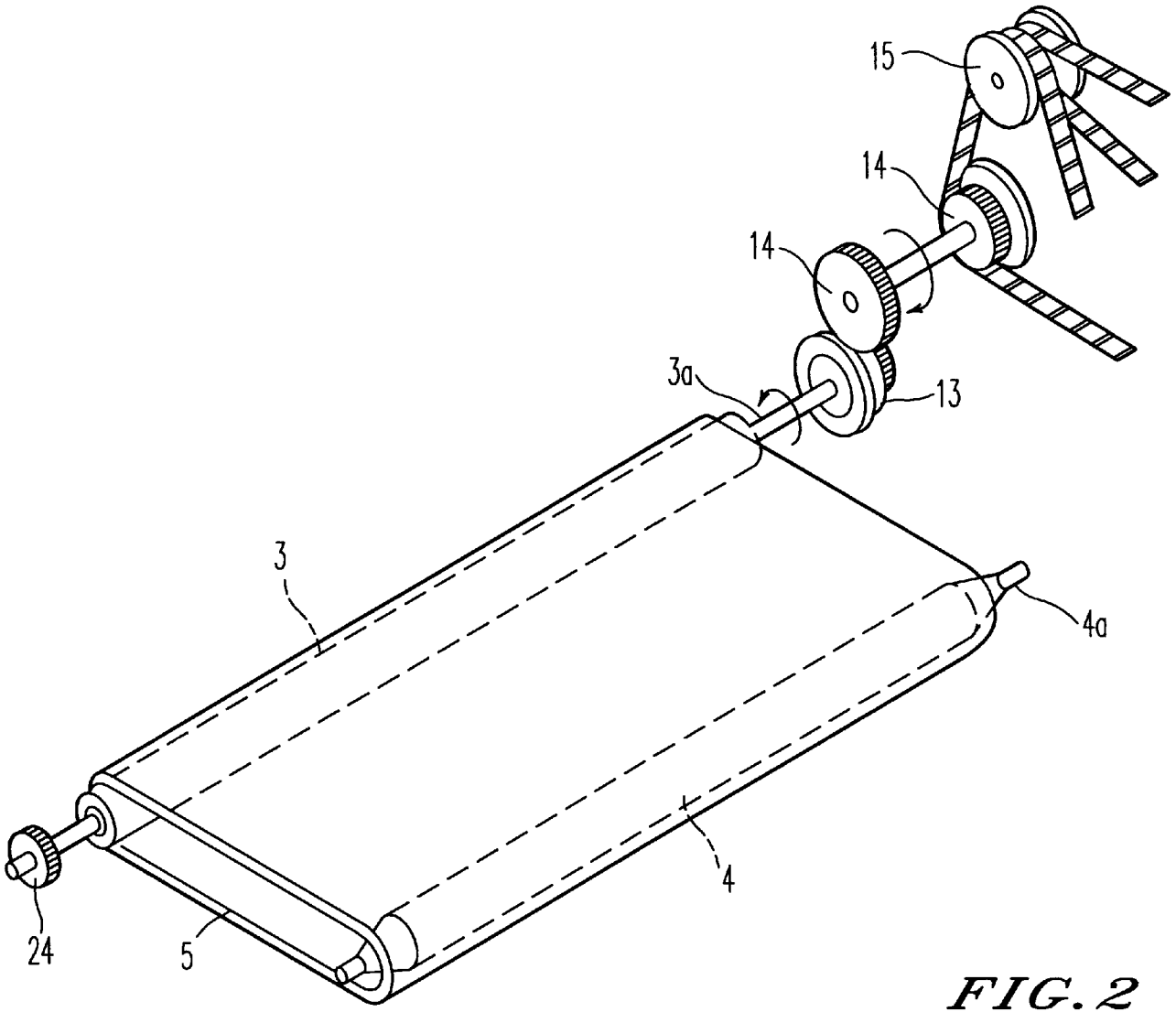
FIG. 2 is a perspective view showing a drive mechanism for driving a transfer belt in the transfer medium according to the present invention.

Turning to FIG. 2 for the moment, the driving roller 3 of the transfer belt 5 is shown to be firmly fixed on a supporting shaft 3*a* through a side plate not shown in FIG. 1 and rotatably supported by the side plate of the case 12 (FIG. 1). A relaying gear 13 is firmly fixed on one end of the supporting shaft 3*a* and is engaged with one of the gears 14, rotatably supported on the main body of the image forming apparatus. The other gear 14 is engaged with a main gear 15 mounted on the main motor of the image forming apparatus. In such structure, the rotative force from the main motor of the image forming apparatus is transmitted to the driving roller 3, and thereby the driving roller 3 is rotatively driven in the direction of the arrow shown in FIG. 2.

The driven roller 4 is firmly fixed on a supporting shaft 4a rotatably supported on the side plate not shown in FIG. 1. The rotative force from the driving roller 3 is transmitted to the driven roller 4 by the action of the transfer belt 5 suspended between the driving roller 3 and the driven roller 4, and thereby the driven roller is rotated. A rubber layer coated with fluorine resin employed as the transfer belt 5 has medium resistance value, the variation of which is small.

Referring to FIG. 1, in the interior of the transfer belt 5, there is provided the transfer bias rollers, the circumferential surface of which is brought into contact with the inner surface of the transfer belt 5. The transfer bias roller 6 is also rotatable supported by the side plate not shown in FIG. 1 and subsequently rotated in accordance with the movement of the transfer belt 5. A transfer bias from a transfer power source 9 disposed in the interior of the case 12 is applied to the transfer bias roller 6. The transfer bias is further supplied to the transfer belt 5. Hereupon, the medium for applying the transfer bias to the transfer belt 5 is not limited to the bias roller 6. Other structural elements such as a brush, a blade, or the like can be used.

The contact plate 7 for leading the transfer bias supplied to the transfer belt 5 from the transfer bias roller 6 to the earth (GND) is disposed on a position opposing to the transfer bias roller 6 in the interior of the transfer belt 5.

The present embodiment adopts a differential constant current method in which the difference between the current supplied to the transfer belt 5 from the transfer bias roller 6 and the other current flowing to ground from the contact plate 7 is made to be constant. The above differential constant current method can be practiced by changing the applied voltage. However, the control of applying the transfer bias is not limited to the differential constant current method. It is also possible to utilize the "constant voltage" control method, the "constant current" control method, the "constant voltage +constant current" control method, or the like. Furthermore, as to the target value to be controlled in the respective control operations, there are three statuses: one target value; plural target values; and end variable target value.

Figure 3:
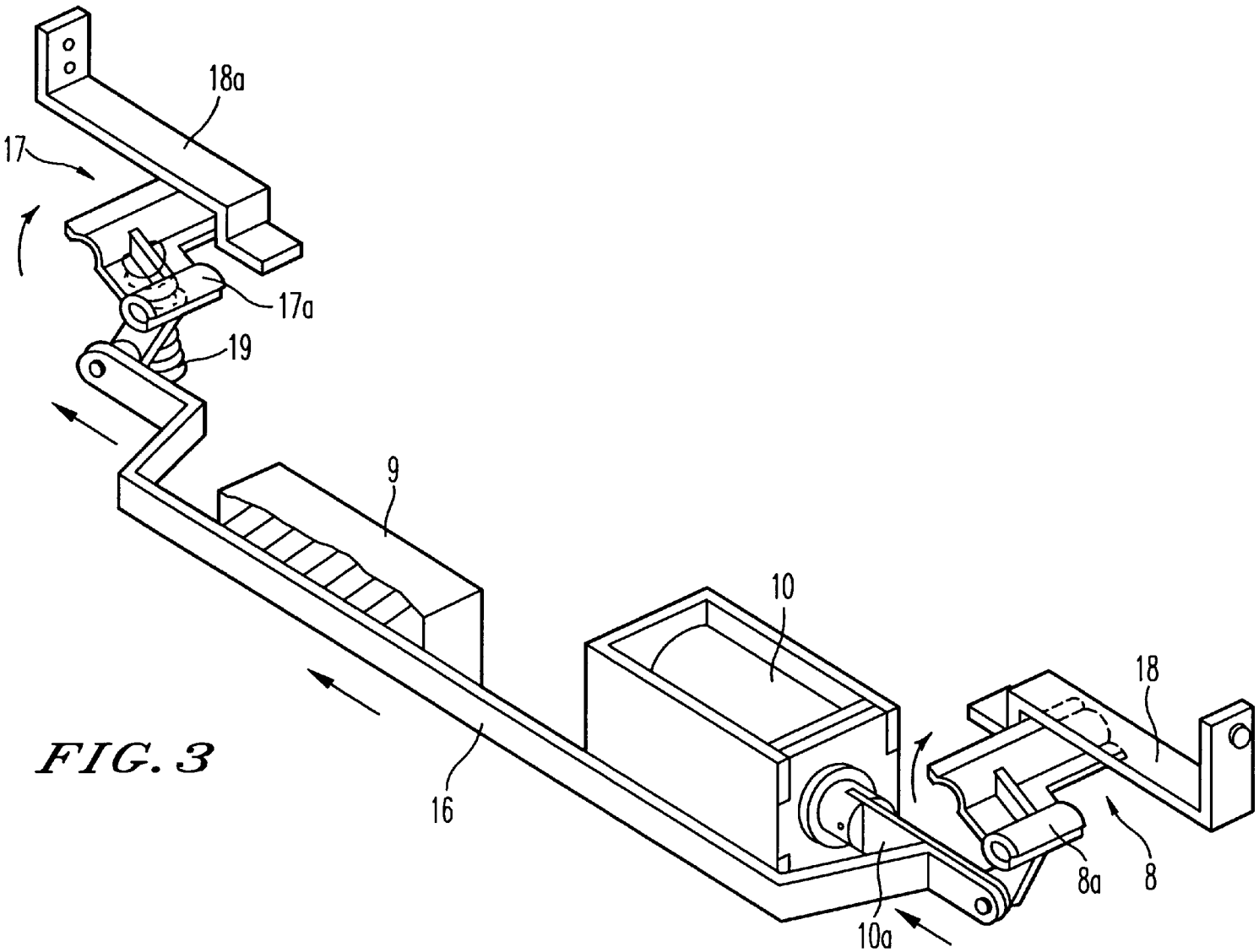
FIG. 3 is a perspective view showing a mechanism for attaching and detaching the transfer belt to and from a photosensitive body.

A solenoid 10 employed as the transfer belt attaching detaching mechanism is disposed below the transfer belt 5, as shown in FIG. 1, and is fixed on the case 12. As shown in FIG. 3, one end of a transmission arm 16 for transmitting the operation of a plunger 10*a* provided in the solenoid 10 is mounted on the plunger 10*a*. Furthermore, one end of the attaching detaching lever 8 formed in a somewhat of an "L" shape and having a bending portion 8*a* rotatively supported on a fixed member, not shown, is mounted on the plunger 10*a*. An attaching/detaching lever 17 having same structure as that of the lever is mounted on the other end of the transmission arm 16 in the same direction as that of the lever 8. A compression coil spring 19 energized in the direction of pushing up the attaching detaching lever 17 in the upward direction is disposed below the other end of the lever 17.

Stays 18, fixed on the side plate, not shown, are respectively mounted on the upper surface of the other end of the attaching/detaching levers 8 and 17.

In such a structure as mentioned heretofore, when the solenoid 10 operates, the plunger 10*a* thereof is drawn in by suction, causing the levers 8 and 17 to rotatively move upward respectively around the respective bending portions 8*a* and 17*a*. As a result, the side plate (not shown) fixed on the stays 18 is moved upward. Thereby, the driven roller 4, the transfer bias roller 6, and the like supported on the side plate, not shown, are moored so as to swing those rollers 4 and 6, etc. around the driving roller 3.

Consequently, the transfer belt 5 can be brought into first position that is in contact with the circumferential surface of the photosensitive drum 1, but can also be brought into another position where the transfer belt 5 parts from the circumferential surface of the drum 1. Furthermore, the structure of the mechanism of attaching or detaching the transfer belt 5 to, or from, the circumferential surface of the photosensitive body 1 is not limited to the embodiment of the present invention.

Referring to FIG. 1, a transfer belt cleaning medium 11 is disposed below the driving roller 3. The transfer belt cleaning medium 11 is mainly composed of a cleaning blade 20 employed as a transfer belt cleaning member, a seal 21, another seal 22, a toner withdrawing coil 23. The basic part of the cleaning blade 20 is fixed on the side plate of the case 12, and the free end thereof is brought into direct contact with the circumferential surface of the transfer belt 5. The seal 21 prevents the toner scraped from the surface of the transfer belt, by the blade 20, from scattering outside of the case 12. The seal 21 is disposed at an upstream side, with respect to a moving direction of the transfer belt 5, from the cleaning blade 20. The seal 22 is for preventing the toner scraped off from the surface of the transfer belt 5 by the cleaning blade 20 from scattering toward the transfer power source 9 and the transfer belt attaching/detaching medium 10. The seal 22 is disposed downstream of the cleaning blade 20. Furthermore, a toner withdrawing coil 23 for conveying the toner thus scraped off to the toner conveying medium, not shown, is disposed below the cleaning blade 20. The toner withdrawing coil 23 is formed in a screw shape.

A rotational force from the gear 24 (refer to FIG. 2) fixed to the other end of the supporting shaft 3*a* is transmitted by a relaying gear not shown, and thereby the coil 23 is rotatively driven. Furthermore a heater 27 is disposed below the transfer belt cleaning medium 11 and is used as a humidity removing medium in order to remove moisture from the toner scraped off by the cleaning blade 20.

Next, the functional operation of the image forming apparatus of the embodiment according to the present invention is described hereinafter.

When the power source of the image forming apparatus is turned on, the main motor is put in operation, and the rotational force is transmitted to the driving roller 3 through the main gear 15, the gears 14, and the relaying gear 13, and thereby the driving roller 3 starts to rotate. The transfer belt thus moves in the direction of the arrow shown in FIG. 1. When a print switch not shown is pushed by an operator, the photosensitive body 1 is charged by the charging medium in the negative polarity (−). The circumferential surface thus charged is exposed to light from a light source so as to form an electrostatic latent image (an image portion) on the light-exposed circumferential surface of the photosensitive body. A developing apparatus applies the toner charged in the positive polarity (+) to the electrostatic latent image thus formed on the photosensitive body 1 and converts the latent image to the visible image. Thereafter, the charge on the photosensitive body 1 is removed by a pre-transfer charge removing lamp 25.

When the print switch is pushed, the solenoid 10 is put in operation and brings the transfer belt 5 into direct contact with the circumferential surface of the photosensitive body 1. Thereafter, the recording paper is fed by the pair of registration rollers 26. At this time, the photosensitive body 1 is brought into direct contact with the transfer belt 5 during the period from when the direct contact is made between the transfer belt 5 and the photosensitive body 1 until the conclusion of the paper feeding operation that proves the transfer paper in the contact portion therebetween. When starting the direct contact therebetween, the inversely charged toner (of the minus polarity) attached onto the non-image portion on the surface of the photosensitive body 1 (from the developing apparatus) is transferred, on some occasions, onto the surface of the transfer belt 5, not electrostatically but physically as a result or bringing the transfer belt 5 into direct contact with the photosensitive body 1.

When the recording paper is fed (into the space) between the photosensitive body 1 and the transfer belt 5, the bias current from the transfer power source 9 is supplied to the transfer bias roller 6 and the transfer bias is applied to the recording paper. When the bias is applied to the recording paper, the normally charged toner (of the plus polarity) attached onto the image portion on the surface of the photosensitive body 1 is drawn (attracted) onto the recording paper by the action of the bias electric potential higher than the surface electric potential of the photosensitive body 1. In such manner, the normally charged toner is transferred onto the recording paper and thereby the image is formed thereon.

The recording paper having the image (toner image) transferred thereon is conveyed to the fixing apparatus (not shown) by use of the transfer belt 5. After a predetermined time period elapses since the rear end of the recording paper leaves the transfer belt 5, the solenoid 10 is put in operation, and the transfer belt 5 is parted from the circumferential surface of the photosensitive body 1. In the subsequent rotation thereof, the photosensitive body 1 turns out to be brought into direct contact with the transfer belt 5. In such situation, the inversely charged toner is physically transferred onto the surface of the transfer belt 5 on some occasions, as in the above-mentioned case of forming the image.

As previously mentioned, the inversely charged toner is physically transferred from the photosensitive body 1 onto the transfer belt 5, accompanying the image forming operation. When the transfer bias is applied to the transfer belt 5 at the time of bringing the transfer belt 5 into direct contact with the photosensitive body 1 in order to prevent the abovementioned situation, the normally charged toner is inevitably absorbed electrostatically by the transfer belt 5. In this situation, the present embodiment performs the control operation, discussed below, to solve the problems such as the dirtying of the rear surface of the recording paper due to the toner transferred and attached to the transfer belt 5 and the insufficient cleaning for the transfer belt.

Figure 4:
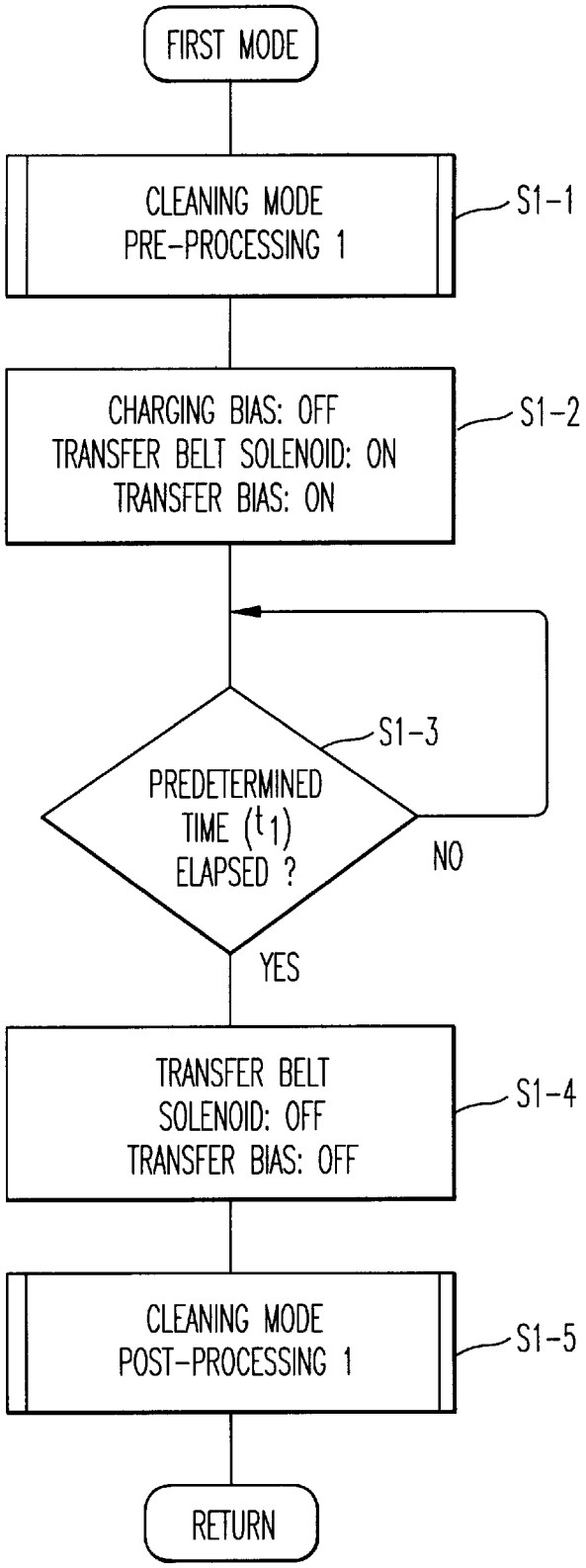
FIG. 4 is a flow chart showing a treatment of the first cleaning mode of the transfer belt.
Figure 5:
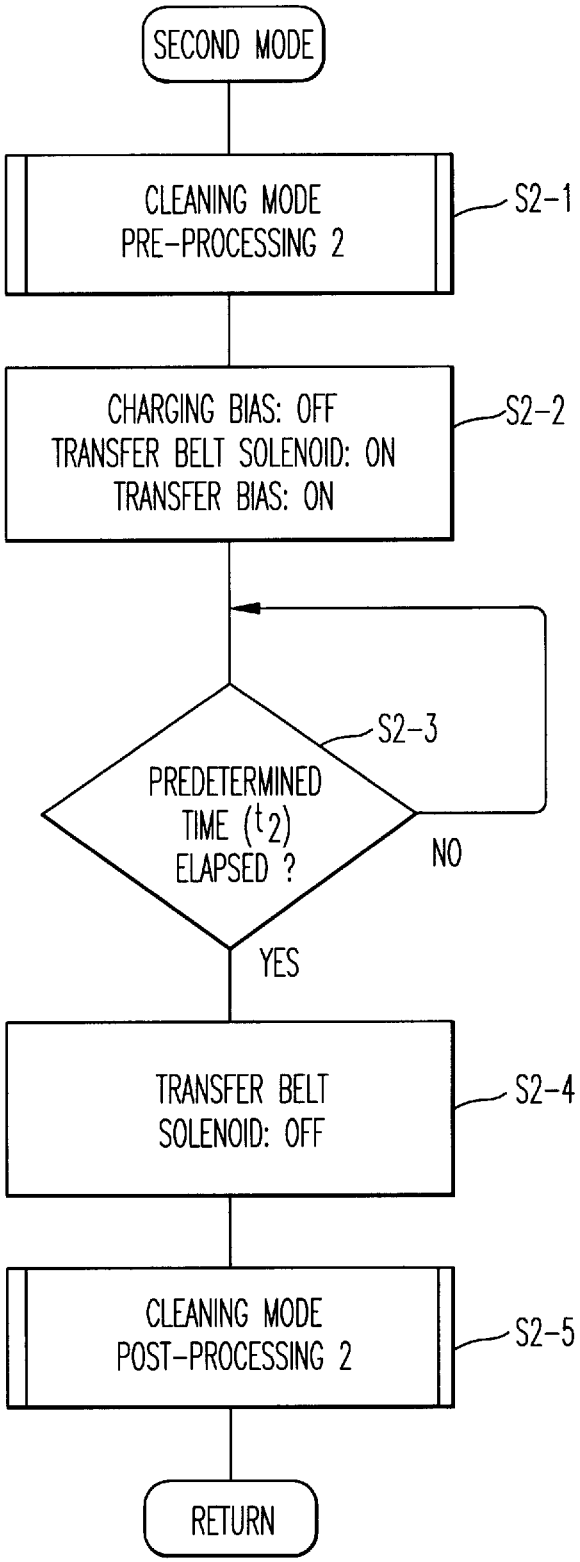
FIG. 5 is a flow chart showing a treatment of the second cleaning mode of the transfer belt.

FIG. 4 is a flow chart showing the process of the first cleaning mode for the transfer belt (hereinafter, called "the first mode") which is performed in order to prevent the problem arisen due to the inversely charged toner. FIG. 5 is a flow chart showing the process of the second cleaning mode for the transfer belt (hereinafter, called "the second mode") which is performed in order to prevent the problem arisen due to the normally charged toner. In tandem, these cleaning modes combine to keep the recording paper, and transfer belt, clean of rogue toner.

In the present embodiment, the mutually contradictory treatments both for the inversely charged toner end the normally charged toner can be taken in order to cope with the problems to be solved as mentioned heretofore. Namely, those two transfer belt cleaning modes (the first mode and the second mode) are suitably executed, and thereby both of the rear surface dirt of the recording paper and the insufficient cleaning for the transfer belt can be prevented effectively, at the same time.

Moreover, prior to the control operation for controlling the execution of those two modes, the respective cleaning modes are first described.

In the first mode, shown in FIG. 4, after performing the cleaning mode pre-process 1 at the step 1-1 (hereinafter, "step" is called "S" for short-hand notation), the charging bias is turned off at S1-2 in order to put the photosensitive body 1 in the non-charged state and the transfer belt 5 to be rotatively driven. At the same time, the transfer belt solenoid 10 is turned on and thereby the transfer belt 5 is brought into contact with the photosensitive body 1. (At this time, the photosensitive body 1 is also driven.) Furthermore, the transfer bias is turned on and thereby the bias is applied to the transfer belt.

Moreover, in order to put the photosensitive body 1 in the non-charged state, another method such as charge erasing by use of an eraser can be employed. Keeping the state during the prescribed (predetermined) time period (S1-3), the transfer belt 5 in parted from the photosensitive body 1 (solenoid 10, OFF), and the transfer bias is turned off (S1-4). Next, the cleaning mode post-process is performed (S1-5). At this time, the first mode is ended.

In the second mode shown in FIG. 5, after performing the cleaning mode pre-process 2 at S2-1, the charging bias is turned off at S2-2 in order to put the photosensitive body 1 in the non-charged state and the transfer belt 5 is rotatively driven. At the same time, the transfer belt solenoid 10 is turned on and thereby the transfer belt 5 is brought into contact with the photosensitive body 1. (At this time, the photosensitive body 1 is also driven). The transfer bias is turned off, and thereby the bias is not applied to the transfer belt 5.

As in the case of the first mode, the photosensitive body 1 can be put in the non-charged state with another method excluding the turning-off of the charging bias. And then, keeping the state during the prescribed (predetermined) time period (S2-3), the transfer belt 5 is parted from the photosensitive body 1 (S2-4). Next, the cleaning mode post-process 2 is performed (S2-5). At this time, the second mode is ended.

Hereupon, the cleaning mode pre-processes 1 and 2 and the cleaning post-processes 1 and 2 in the first and second modes respectively perform the treatments required as the cleaning mode excluding the processes in the other steps. Those treatments are ON/OFF treatment for the main motor, eraser treatment, QL/PTL treatment, developing apparatus driving treatment, and bias treatment, etc.

In the first mode shown in FIG. 4, the transfer belt 5 is brought into contact with the photosensitive body 1 put in the non-charged state, and thereby the transfer bias is applied thereto. The inversely charged toner having the polarity inverse to that of the transfer bias (inversely charged toner attached to the transfer belt 5) is electrostatically transferred to the photosensitive body 1, and thereby the rear surface dirt of recording paper can be prevented. Moreover, in the second mode shown in FIG. 5, the transfer belt 5 is brought into contact with the photosensitive body put in the noncharged state and the transfer bias is not applied thereto. Thereby, the normally charged toner attached to the transfer belt 5 is transferred to the photosensitive body 1. In such manner, the insufficient cleaning for the transfer belt 5 can be prevented.

In the case of bringing the transfer belt 5 into contact with the photosensitive body 1 without charging the photosensitive body 1 and without applying the transfer bias thereto, it has been understood based on experience that the normally charged toner on the transfer belt 5 is transferred onto the photosensitive body 1. However, it seems that the above-mentioned matter is due to the influence of the electric potential remaining on the photosensitive body 1.

Furthermore, in the case of charging the photosensitive body 1 in order to return the normally charged toner on the transfer belt 5 onto the photosensitive body 1, there arises a troublesome issue in that the toner is absorbed (attracted) from the developing apparatus, which is not desirable. Hereupon, the inversely charged toner and the normally charged toner both return to the photosensitive body 1 are removed by the cleaning medium not shown for cleaning the photosensitive body 1.

Now, the control operation for practicing the abovementioned first and second transfer belt cleaning operations is explained hereinafter. Here, the control operation relating to the first mode is explained referring to FIG. 6 and FIG. 7, while the control operation relating to the second mode is explained referring to FIG. 8.

Figure 6:
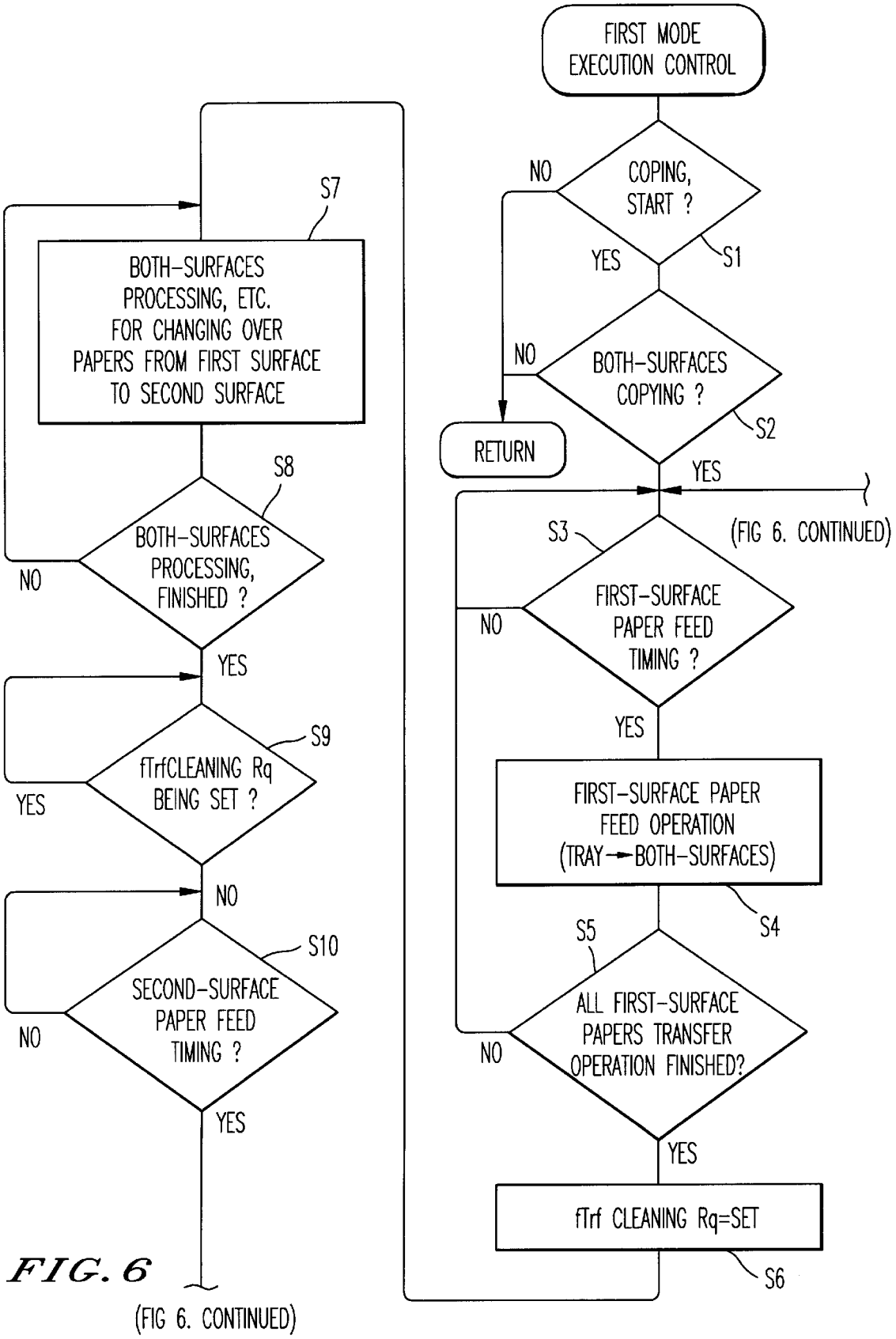
FIG. 6 is a flow chart showing a performance control of the first cleaning mode of the transfer belt.
Figure 6:
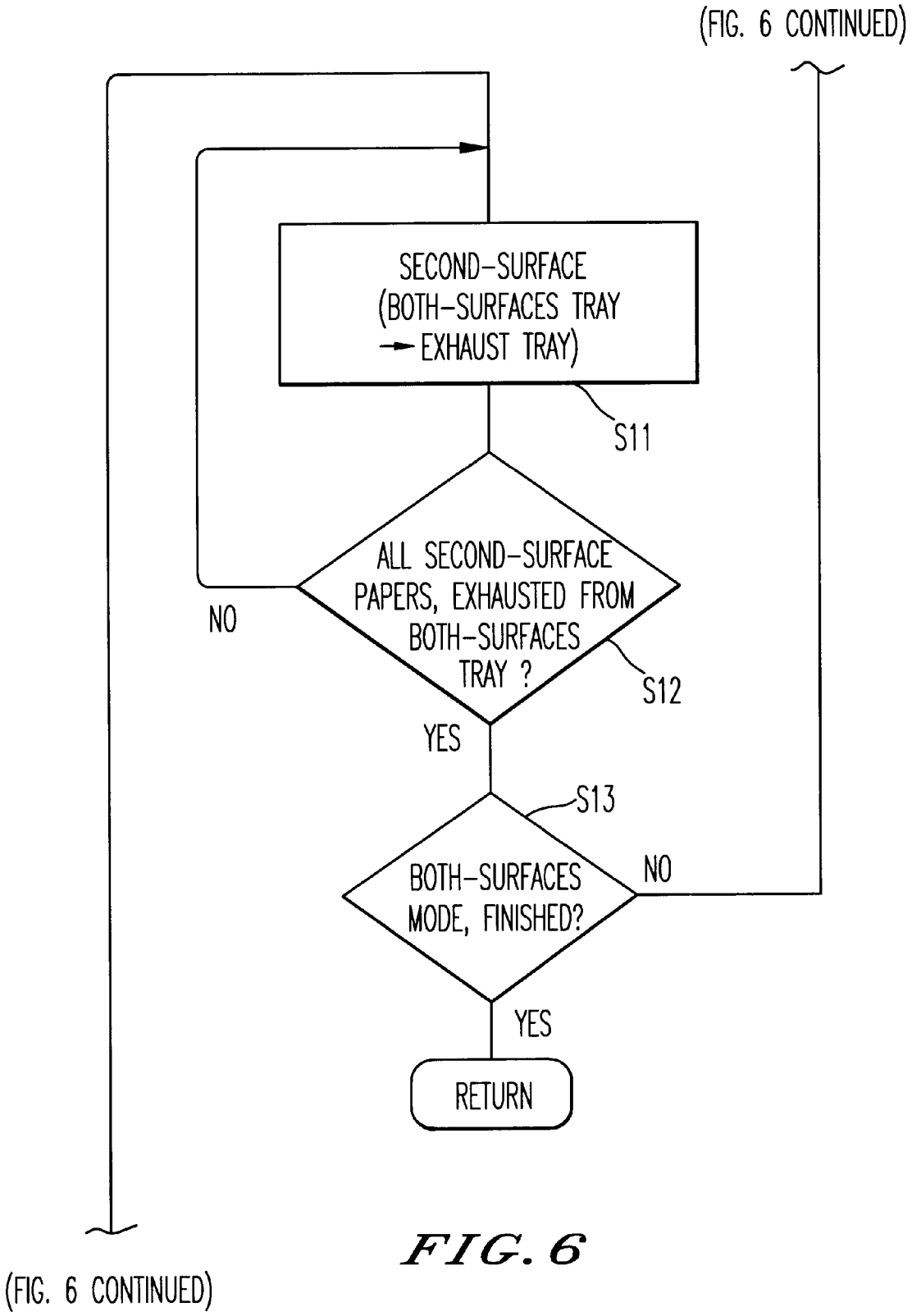
Figure 7:
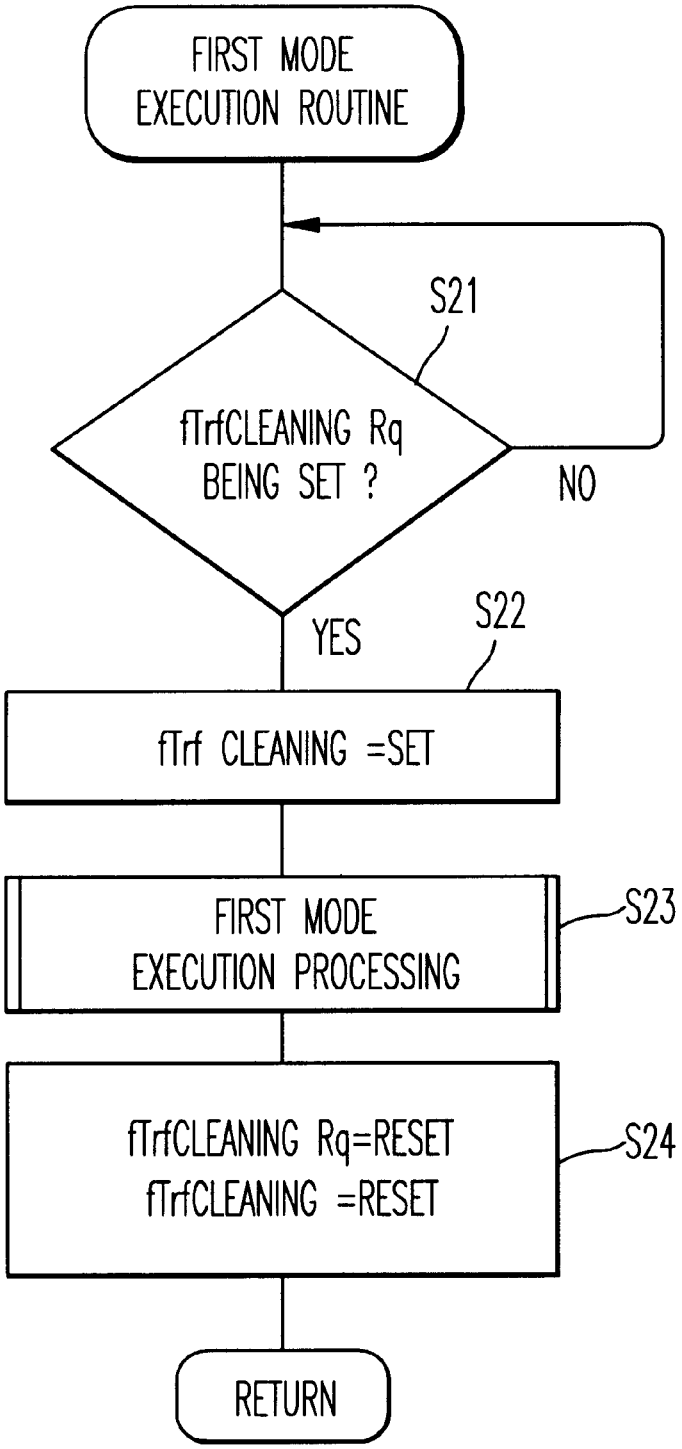
FIG. 7 is another flow chart showing the performance routine of the first cleaning mode of the transfer belt.

Both of the execution starting condition and the execution starting timing conditions of the above described first mode are prescribed in the flow charts shown in FIGS. 6 and 7. In the present embodiment, the first mode is practiced for the both-surface copying mode. To state more concretely, the treatment for the first surface in the both-surface modes is shown by S3–S5 in FIG. 6 and that for the second surface is shown by S9–S12 in FIG. 6. Furthermore, S7-S8 show the treatment operation for performing the recording paper alignment to provide for refeeding the recording paper from the both-surfaces paper tray and the waiting (stand-by) treatment operation for preparing the above performance, after finishing to stack the recording paper in the both-surfaces paper tray, not shown.

Moreover, the first mode can be executed not only for the both-surfaces mode, but for the synthetic mode (synthetic copying mode), that is, the mode utilizing the intermediate tray (called both-surfaces tray, synthetic tray, intermediate tray, etc.) In the flow chart of FIG. 6, it is first determined whether the copying operation is started and whether the copying operation is that of the both-surfaces mode are judged at first (S1, S2). In the case of the both-surfaces copying mode, the timing of the paper feeding onto the first surface is judged (S3), and the paper feeding operation is performed (S4) for the first surface following the above judgment. Next, whether the transferring operation for the first surfaces of the predetermined number (sheet number) is finished is judged (S5).

When the transferring operation is finished for the first surface of the final recording paper, since there exists basically no influence exerted on the image transferred onto the recording paper, the aforementioned first mode can be executed. And then, the first mode execution allowing flag (fFrfCleaningRq) is set (S6). When the execution allowing flag is set, the polling operation is performed with the first mode execution routine shown in FIG. 7. Namely, when the execution allowing flag is set, the routine shown in FIG. 7 is processed in parallel in the multiple task with the routine shown in FIG. 6. In the routine shown in FIG. 7, whether there exists the request of executing the above-mentioned first mode is judged (S21). If there exists the executing request "namely, if the execution allowing flag is set), the flag showing that the first mode is executing (fTrfCleaning) is set (S22), and the process of the first mode shown in FIG. 4 is performed (S23). And then, the flag of allowing the first mode execution and the other flag showing that the first mode is being executed are respectively reset (S24). Moreover, the flag showing that the first mode set at S22 is executing is referred to at S9 of the routine shown in FIG. 6.

Going back to the routine shown in FIG. 6, the aforementioned both-surfaces treatment is preformed (S7) after setting the first mode execution allowing flag at S6, the completion of the treatment is established (S8), and then the flag showing that the first mode is being executed (ffrfcleaning) is referred to (S9). In case that the first mode is being executed, the apparatus waits until the ending of the treatment. On the contrary, in case that the first mode is not being executed, the timing of the second surface paper feeding is judged (S10) and the paper feeding operation is performed (S11) for the second surface. The apparatus waits until the end of the treatment (S12) and judges the ending of the both surfaces mode (S13).

The operation of referring to the flag showing that the first mode is being executed at S9 (fTrfCleaning) is performed for the purpose that, if the first mode is being executed, the paper feeding operation for the second surface (the paper feeding operation from the both surfaces tray) is inhibited, even though the both-surfaces treatment for changing over from the first surface to the second surface comes to an end, and then the paper feeding operation from the both-surfaces tray is performed after completing the first mode.

Consequently, the execution of the copying sequence can be secured and the treatment execution of the first mode can he made reliable at the same time, and further the dirtying of the rear surface of the recording paper can be surely prevented.

In the present embodiment, after completing the transferring operation for the first surface of the final recording paper among the recording papers stacked in the both-surfaces tray, namely, during the time period of changing over from the first surface to the second surface in the both-surfaces mode, the first mode turns out to be practiced. Consequently, lowering of the productivity can be suppressed to minimum.

Next, the control operation of executing the second mode shown in FIG. 5 is explained hereinafter, referring to FIG. 8. In the present embodiment, the non-image-forming mode is executed after copying the prescribed number of recording papers or after turning on the electric power source, and thereafter the second mode is practiced subsequently to the non-image-forming mode.

The above-mentioned non-image-forming mode represents the adjustment mode such as an adjustment mode for controlling the image density, a cleaning mode, a fixing pre-rotation mode, and so on.

Furthermore, in the present embodiment, the execution time for the second mode can be changed in accordance with the preceding mode hereupon, as the mode preceding the second mode execution, the following processes arc established:

(1) Fixing Rising-up Pre-Treatment which is the nonimage-forming mode after turning on the power source (treatment of causing the fixing apparatus to operate for the predetermined time period in order to keep uniform the temperature of the fixing roller after turning on the power source), (2) Charging Roller Cleaning Mode which is the non-image forming mode practiced after copying the prescribed number of the recording paper cleaning mode for cleaning the surface of the charging roller per a prescribed number of the recording papers, for instance, 200 sheets, and (3) Operation of Forming the Process Control Pattern, in which the toner pattern image is formed on the photosensitive body 1 per each of the respective prescribed number of the recording papers for the purpose of time elapsed variation, the density of the toner pattern image is detected, the compensation value is calculated on the basis of the detected density, and thereby the time elapsed shift of the toner image is adjusted (compensated). The control of executing the second mode is explained hereinafter.

Figure 8:
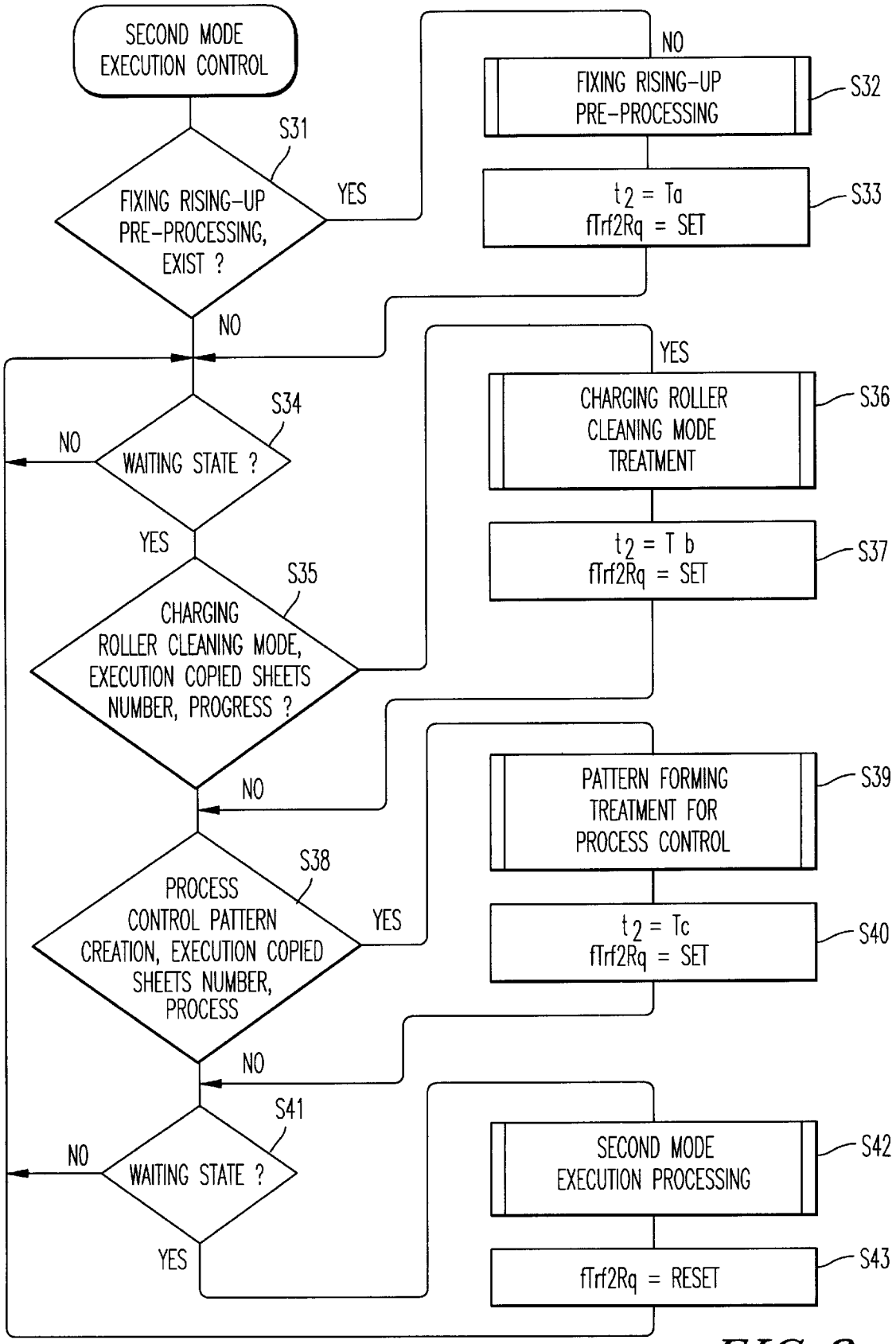
FIG. 8 is a flow chart showing a performance control of the second cleaning mode of the transfer belt.

In the flow chart shown in FIG. 8, at first, whether the fixing rising-up pre-treatment (pre-processing) executed after turning on the power source of the apparatus should be practiced is judged (S31). In the case of not practicing the above pre-treatment, the process makes progress to S34. In the present embodiment, the fixing rising-up pretreatment is practiced, only when the fixing temperature at the time of turning on the power source is equal to or lower than 50° C. Consequently, when the fixing temperature at the time of power-on is not higher than 50° C., the process makes progress to S32, and the fixing rising-up pre-treatment is practiced at that time.

When the pre-treatment is finished, the second mode practicing time Ta after the fixing rising-up pre-treatment is set to the variable t2 for prescribing the practicing time for the second mode. Furthermore, the flag indicating the second mode execution (fTrf2Rq) is Set (S33). And then, the rising-up of the fixing apparatus is confirmed (whether the apparatus is in the waiting or stand-by state) is judged (S34).

When the rising-up of the fixing apparatus is confirmed, whether the charging roller cleaning mode is practiced is judged (S35), and whether the formation mode of the process control pattern is practiced is also judged (S38).

When those modes are not practiced, the aforementioned flag (fTrf2Rq) is confirmed (S41), and the second mode is practiced for the prescribed time period Ta (S42). And then, the above flag (fTrf2Rq) is reset and returns to the step prior to S34.

Hereupon, in the present embodiment, the charging roller cleaning mode and the creation of the process control pattern are practiced, only, after the fixing apparatus rises up and when the copying operation is not performed (at the time of putting the apparatus in the waiting state). On this occasion, in order to practice the charging roller cleaning mode, the number of the copied papers since the execution of the same mode (charging roller cleaning mode at the last time) is judged (S35). In case that the prescribed number of the recording papers are copied, the charging roller cleaning mode is practiced (S36). And then, the counter for memorizing the prescribed number of sheets for practicing the charging roller cleaning mode is reset in preparation for the next time.

Next, at S37, practicing time Tb for practicing the second mode after the charging roller cleaning mode is set to the variable t2 for prescribing the second mode practicing time.

And further, the aforementioned flag (fTrf2Rq) is set. Furthermore, in the care of forming the process control pattern, the same treatment is also practiced. And then, the second mode practicing time is set to Tc and the flag (fTrf2Rq) is also set (S39).

Although it has been previously mentioned that the second mode was practiced for the prescribed time Ta after practicing the fixing rising-up pre-treatment, in the case of practicing the charging roller cleaning mode, the time of practicing the second mode is Tb. Furthermore, in the case of practicing the process control pattern formation, the second mode practicing time is Tc. The second mode practicing time in the case of practicing the second mode by duplicating those non-image forming modes turns out to be the practicing time finally set to the variable t2, as is apparent from the flow chart of FIG. 8.

As described heretofore, in the present embodiment, the practicing time of the second mode can be changed in accordance with the mode preceding the second mode execution. The second mode is practiced subsequently to the (just) preceding nonimage-forming mode. Therefore, when the preceding mode is long, if the transfer belt clearing modes further practiced subsequently thereto, the operation has to wait for a long time. For this reason, the practicing time of the second mode is made variable in accordance with the preceding non-image-forming mode (in case that the preceding non-image-forming mode is long, the second mode practicing time is made necessarily a minimum), and thereby the waiting time can be made as short as possible.

Consequently, keeping the easiness of cleaning the transfer belt, the waiting time (the waiting time due to carrying or adding the cleaning mode) can be suppressed to the smallest. In the present embodiment, among the three sorts of the adjustment mode, the practicing time of the pre-treatment for the fixing rising-up is longer than that of the other two adjustment modes. For this reason, if the practicing time of the second mode after practicing the pre-treatment of the fixing rising-up is made (set) short the waiting time for the user at the time of the apparatus rising-up can be made as short as possible.

Furthermore, as mentioned above, the second mode practicing time in the case of practicing the second mode duplicating the non-image-forming mode turns out to be the practicing time finally set to the variable t2. At this time , the second mode is practiced only one time. Namely, if the condition of practicing the second mode is competed (duplicated), the apparatus is constructed so as to practice the second mode only once.

As mentioned heretofore, in the present embodiment, the second mode is practiced subsequently to the non-image-forming mode (adjustment mode) to be performed after copying the prescribed number of the recording papers or turning on the power source. Therefore, the transfer belt clearing mode turns out to be periodically practiced. Thereby, the normally charged toner attached onto the transfer belt is removed by cleaning and the insufficient cleaning for the transfer belt can be prevented.

Hereupon, understanding the mechanism by which the recording paper becomes dirty due to the inversely charged toner, it has been understood that the rear surface dirt of the recording paper tends to occur easily at the time of re-feeding the recording paper from the both-surfaces tray (intermediate tray in the both-surfaces mode, synthetic mode, etc.), for the reason of the variation of the recording paper's resistance value or the increase of the transfer bias (rising-up of the transfer bias from the time of the first surface transferring to the time of the second surface transferring), etc.

In such situations, the present embodiment practices the first mode at the time of the both-surfaces mode (other mode employing the intermediate tray), and thereby effectively prevents the rear surface dirt of the recording paper.

Furthermore, the first mode is practiced after completing the transferring operation to the final recording paper among the recording papers stacked in the intermediate tray such as the both-surfaces tray, the synthetic tray, etc. Thereby, the first mode is practiced during the time period of changing over the both-surfaces mode from the first surface to the second surface (in the synthetic mode, from the first image to the second image). Consequently, the lowering of the productivity can be suppressed to the minimum.

Furthermore, in case that the first mode is practiced during the time period of changing over the both-surfaces mode from the first surface to the second surface, the troublesome matter may happen when the practicing time of the first mode is longer than the time of the changing-over process.

Usually, in the mode employing the to the surfaces tray, etc., after stacking the recording paper in the both-surfaces tray, etc., there additionally occurs a work of aligning the recording paper (treatment of aligning the recording paper in the lengthwise direction and in the lateral direction). Therefore, waiting time occurs inevitably until the recording paper from the both-surfaces tray is fed again.

Although the practicing time of the first mode can be set to a time shorter than the above waiting time, the practicing time of the first mode can be set to a long time on some occasions in accordance with the restriction on the layout or the conditions of the copying speed, the transfer belt length, or the extent of the dirt on the belt, and so on.

On such occasions, even though the both-surfaces tray is used to re-feed the recording paper therefrom, there arises a case of not finishing the treatment of the first mode. (Since the waiting time in the synthetic mode is short in general, the probability relating to this case turns out to be high). However, in the present embodiment, by allowing to re-feed the recording paper from the both-surfaces tray, etc. after finishing the first mode (in case that the practicing time of the first mode is long) the productivity is lowered to some extent. Nevertheless, the certain practice of the copying sequence (the essential operation of the image forming apparatus) can be secured surely and the rear surface dirt on the recording paper can be prevented.

Moreover, although the transfer belt is employed as the transfer medium in the present embodiment, the present invention is applicable to the other contact type charging medium such as the transfer roller. Moreover, the present invention can accomplish the functional effect regardless of the one-component developer or the two-components developer. Furthermore, the practicing timing of the first end second modes is not limited to the present embodiment. The timing can be set suitably.

As is apparent from the foregoing description, according to the image forming apparatus and method of the present invention, since the apparatus has the first and second cleaning modes, the apparatus can effectively prevent the inversely charged toner and the normally charged toner from attaching to the transfer medium required to be taken the mutually contradictory treatments for the countermeasure against the above problems. Thereby, the rear surface dirt on the recording paper and the insufficient cleaning for the transfer medium can be surely prevented.

Furthermore, the rear surface dirt of the recording paper can be effectively prevented by practicing the first transfer belt cleaning mode at the time of the image forming mode employing the intermediate tray which tends to easily dirty the rear surface of the recording paper, and thereby lowered productivity can be suppressed to the minimum. Furthermore, the cleaning operation can be periodically practiced by executing the second transfer belt cleaning mode following the adjustment mode, and thereby the insufficient cleaning of the transfer medium can be prevented effectively.

Furthermore, the re-feeding of the recording paper from the intermediate tray is allowed after finishing the first transfer belt cleaning mode, and thereby the sure execution of the copying sequence (the essential operation of the image forming apparatus) can be secured, and further the rear surface dirt of the recording paper can be prevented.

Since the practicing time of the second mode is set in accordance with the adjustment mode prior to the execution of the second transfer belt cleaning mode, the easiness of cleaning the transfer medium can be secured and the waiting time can be suppressed to the minimum.

Furthermore, in case that the condition of practicing the second transfer belt cleaning mode is competed (duplicated), by practicing the second mode only one time, the waiting time after practicing the adjustment mode can be made minimum and the cleaning operation for the transfer medium can be performed at the same time.

Although one embodiment of the present invention has been described heretofore, the present invention is not limited to the embodiment. There are other embodiments or the modifications thereof applicable to the invention, for instance, the apparatus employing transfer drum or transfer roller instead of the transfer belt, or the apparatus employing the photosensitive belt instead of the photosensitive drum as the image carrier, or the like.

The present document claims priority to Japanese Patent Application No. 9-043917, the entire contents of which is incorporated herein by reference.

What is claimed as new and is desired to be secured by Letters: Patent Of The United States Is:

1. An image forming apparatus comprising:

an image carrier configured to carry a visible image;

transfer means for transferring thereto the visible image from the image carrier, said transfer means having, means for controllably attaching said transfer means to be in contact with said image carrier and detaching said transfer means from said image carrier, when attached, said transfer means being positioned to guide a recording medium to a contact position between said transfer means and said image carrier, and means for applying a transfer bias to said transfer means so as to electrostatically transfer the visible image onto the recording medium;

drive means for rotatively driving said transfer means;

means for executing a first transfer belt cleaning mode of operation having means for imparting a non-charged state on said image carrier while causing said drive means to rotatively drive said transfer means, cause said means for controllably attaching to bring said transfer means into contact with said image carrier, and cause said means for applying to apply the transfer bias to the transfer means; and means for executing a second transfer belt cleaning mode of operation imparting the non-charged state on the image carrier, causing said drive means to rotatively drive said transfer means, cause said means for controllably attaching to bring said transfer means into contact with said image carrier, and cause said means for applying to avoid applying the transfer bias to the transfer means.

2. The image forming apparatus as defined in claim 1, further comprising:

an intermediate tray configured to hold the recording medium and another recording medium on which images are formed on both sides of said recording medium and said another recording medium when a doubled-sided mode of operation is performed;

control means for controlling said first transfer belt cleaning mode of operation to be executed when said recording medium is fed from said intermediate tray to said contact position during said doubled-side mode of operation and when said another recording medium is fed again from said intermediate tray after finishing an image transferring operation for a last visible image to the another recording medium, and for controlling said second transfer belt cleaning mode of operation to be performed after performing an adjustment mode of operation when no visible images are being formed.

3. The image forming apparatus as defined in claim 2, wherein:

said control means comprises means for temporarily inhibiting said recording medium from being fed from the intermediate tray when it is determined that said first transfer belt cleaning mode of operation is not yet completed, and feeding said recording medium after determining that said first transfer belt cleaning mode of operation is complete.

4. The image forming apparatus as defined in claim 2, wherein:

said adjustment mode of operation comprises at least one mode selected from a plurality of modes and said control means performs said second transfer belt cleaning mode of operation after the selected at least one mode has completed.

5. The image forming apparatus of claim 4, wherein:

said adjustment mode of operation performs at least two of the plurality of modes and said control means performs said second transfer belt cleaning mode of operation only once after said at least two of said plurality of modes are completed.

6. A method of forming an image in an image forming apparatus comprising the steps of:

preparing an image carrier for carrying a visible image to be developed by a developer;

positioning an image transfer device to contact said image carrier at a contact position, said image transfer device being controllable configured to be detachably attached to said image carrier;

driving the image transfer device to rotate in a predetermined direction;

guiding a recording medium to the contact position between the image transfer device and the image carrier;

applying a transfer bias to said image transfer device and electrostatically transferring the visible image onto the recording medium so as to form an image thereon;

executing a first transfer belt cleaning mode of operation by, placing said image carrier in a non-charged state, bringing said image transfer device into contact with said image carrier, driving said image transfer device, and applying the transfer bias to the image transfer device; and executing a second transfer belt cleaning mode of operation by, placing said image carrier in the non-charged state, and bringing said image transfer device into contact with said image carrier, driving said image transfer device, and preventing said transfer bias from being applied to said image transfer device.

7. The method of claim 6, further comprising the steps of:

moving said recording medium and another recording medium to an intermediate tray when performing a double-sided mode of operation;

executing said first transfer belt cleaning mode of operation a first time when said recording medium is fed from said intermediate tray to said contact position during said doubled-side mode of operation and a second time when said another recording medium is fed again from said intermediate tray after finishing an image transferring operation for a last visible image to the another recording medium; and executing said second transfer belt cleaning mode of operation after performing an adjustment mode of operation when no visible images are being formed.

8. The method of claim 7, wherein:

said step of executing said first transfer belt cleaning mode of operation includes temporarily inhibiting said recording medium from being fed from the intermediate tray when it is determined that said first transfer belt cleaning mode of operation is not yet completed, and feeding said recording medium after determining that said first transfer belt cleaning mode of operation is complete.

9. The method of claim 7, wherein:

said step of controlling said second transfer belt cleaning mode of operation includes waiting until after one mode selected from a plurality of modes of said adjustment mode of operation is completed before executing said second transfer belt cleaning mode of operation.

10. The method of claim 9, wherein:

said step of controlling said second transfer belt cleaning mode of operation includes waiting until after more than one of said plurality of modes of said adjustment mode of operation are completed before executing said second transfer belt cleaning mode of operation.

11. An image forming apparatus comprising:

an image carrier configured to carry a visible image;

a transfer device driving mechanism;

a rotatable transfer device coupled to said transfer device driving mechanism;

a bias mechanism configured to apply a bias voltage to said transfer device;

a controllable transfer device attachment mechanism connected to said rotatable transfer device and configured to move said rotatable transfer device toward said image carrier so as to contact said image carrier at a predetermined contact position, including, a transmission arm having a first end and a second end;

an active movement mechanism connected to the first end of the transmission arm, the second end of the transmission arm connected to a locking member, activation of said active movement mechanism in a first state causing said transmission arm to move in a predetermined direction and disengage from said locking member so as to permit said rotatable transfer device to detach from said image carrier, activation of said active movement mechanism in a second state causing said transmission arm to move in a direction opposite to said predetermined direction and lock said rotatable transfer device into a contact position with said image carrier;

a charge erasure mechanism configured to erase a charge from said image carrier;

a controller configured to control an operation of said active movement mechanism, said bias mechanism and said charge erasure mechanism, wherein, when performing a first transfer belt cleaning mode of operation, said controller controlling said charge erasure mechanism to place said image carrier in a non-charged state, activate said bias mechanism to apply said bias voltage to said transfer device, and activate said active movement mechanism in said second state so as to contact said transfer device against said image carrier, and when performing a second transfer belt cleaning mode of operation said controller controlling said charge erasure mechanism to place said image carrier in the non-charged state, deactivate said bias mechanism to as to avoid applying said bias voltage to said transfer device, and activate said active movement mechanism in said second state so as to contact said transfer device against said image carrier.

* * * * *